US011178932B2

(12) United States Patent
Danezin

(10) Patent No.: US 11,178,932 B2
(45) Date of Patent: Nov. 23, 2021

(54) DEVICE FOR TIGHTENING A SPORTS BOOT

(71) Applicant: SALOMON S.A.S., Epagny Metz-Tessy (FR)

(72) Inventor: Jean-Bruno Danezin, Chilly (FR)

(73) Assignee: SALOMON S.A.S., Epagny Metz-Tessy (FR)

( * ) Notice: Subject to any disclaimer, the term of this patent is extended or adjusted under 35 U.S.C. 154(b) by 0 days.

(21) Appl. No.: 16/204,116

(22) Filed: Nov. 29, 2018

(65) Prior Publication Data

US 2019/0159544 A1 May 30, 2019

(30) Foreign Application Priority Data

Nov. 30, 2017 (FR) ..... 17 71289

(51) Int. Cl.

| | |
|---|---|
| ***A43B 5/04*** | (2006.01) |
| ***A43C 11/14*** | (2006.01) |
| ***A43C 11/08*** | (2006.01) |
| ***A43B 7/20*** | (2006.01) |
| ***A43C 11/00*** | (2006.01) |

(52) U.S. Cl.

CPC ..... *A43B 5/0433* (2013.01); *A43C 11/08* (2013.01); *A43C 11/1493* (2013.01); *A43B 7/20* (2013.01); *A43C 11/008* (2013.01); *A43C 11/14* (2013.01)

(58) Field of Classification Search

CPC ... A43B 5/0433; A43B 5/0476; A43B 5/0478; A43B 5/048; A43B 5/0482; A43B 5/0484; A43B 5/0486; A43B 5/0488; A43B 7/20; A43C 11/1493; A43C 11/08; A43C 11/008; A43C 11/14; A43C 11/1406; A43C 11/1413; A43C 11/142; A43C 11/1426; A43C 11/1433; A43C 11/144; A43C 11/1446; A43C 11/1453; A43C 11/146;

(Continued)

(56) References Cited

U.S. PATENT DOCUMENTS 4,510,703 A * 4/1985 Eiteljorg ..... A43B 5/0415 24/68 SK
5,590,481 A 1/1997 Vaccari (Continued)

FOREIGN PATENT DOCUMENTS

DE 3431746 A1 * 3/1985 ..... A43B 5/0496
DE 102011012159 A1 * 11/2011 ..... A43C 11/008

(Continued)

*Primary Examiner* — Sharon M Prange
*Assistant Examiner* — Grace Huang
(74) *Attorney, Agent, or Firm* — Greenblum & Bernstein, P.L.C.

(57) ABSTRACT

Sports boot including a shell and a liner, the shell extending upward so as to at least partially surround the lower leg of a user and including at least one tightening device configured to tighten the lower leg of the user. The tightening device includes the following: a first strap portion attached to the shell using a first anchoring mechanism; a second strap portion; mechanism configured to pair the first strap portion with the second strap portion; adjusting mechanism configured to adjust the length of the first strap portion or the length of the second strap portion; and a second anchoring mechanism configured to optionally connect the second strap portion to the shell.

6 Claims, 4 Drawing Sheets

(58) Field of Classification Search
CPC ..... A43C 11/1466; A43C 11/1473; A43C 11/148; A43C 11/1486
USPC ..... 36/117.2, 117.3, 117.4, 117.5, 117.6, 36/118.2, 118.3, 118.4, 118.5, 118.6, 36/118.7, 118.8, 118.9
See application file for complete search history.

(56) References Cited

U.S. PATENT DOCUMENTS

| | | | | | |
|---|---|---|---|---|---|
| 5,894,684 | A * | 4/1999 | Sand | A43B 7/20 | 36/115 |
| 6,026,594 | A | 2/2000 | Fougere | | |
| 7,827,708 | B2 * | 11/2010 | Gazzola | A43B 5/14 | 36/131 |
| 2005/0102860 | A1 * | 5/2005 | Sartor | A43B 5/0429 | 36/50.5 |
| 2007/0294918 | A1 * | 12/2007 | Hubner | A43B 23/06 | 36/50.1 |
| 2019/0208857 | A1 * | 7/2019 | Constantine | A43B 5/185 | |

FOREIGN PATENT DOCUMENTS

| | | | | | |
|---|---|---|---|---|---|
| EP | 0123673 | A1 * | 10/1984 | A43C 11/1406 | |
| EP | 0 642 747 | A1 | 3/1995 | | |
| EP | 0654228 | A1 * | 5/1995 | A43B 5/0433 | |
| EP | 0733312 | A1 * | 9/1996 | A43C 11/1493 | |
| EP | 1 087 676 | B1 | 9/2005 | | |
| EP | 1 642 514 | A1 | 4/2006 | | |
| EP | 1 484 992 | B2 | 7/2006 | | |
| EP | 2 494 880 | A1 | 9/2012 | | |
| FR | 1330828 | A * | 6/1963 | A43C 11/1413 | |
| FR | 2889036 | A1 * | 2/2007 | A43C 11/14 | |
| WO | WO-2016/075621 | A1 | 5/2016 | | |

* cited by examiner

DEVICE FOR TIGHTENING A SPORTS BOOT

CROSS-REFERENCE TO RELATED APPLICATION

This application is based upon French Patent Application No. FR 17/71289, filed Nov. 30, 2017, the disclosure of which is hereby incorporated by reference thereto in its entirety, and the priority of which is claimed under 35 U.S.C. § 119.

BACKGROUND

1. Field of the Invention

The invention relates to a strap for retaining and tightening a sports boot. More particularly, the present invention relates to a so-called lower leg tightening strap, as it retains and tightens the upper portion of a sports boot against the lower leg of a user. Straps of this type are used in ski boots, and in particular in boots comprising a rigid shell and an inner comfort element referred to as an inner liner.

2. Background Information

In the practice of downhill alpine skiing or alpine ski touring, the downhill phases, strictly speaking, require a solid rear support in the area of the user's lower leg. Therefore, the majority of ski boots include a collar, at least the rear portion of which is rigid and mechanically takes support on the shell base of the boot. In addition to the various boot closure devices that make it possible to adjust the shell against the foot of the user, a tightening device is provided to connect the lower leg of the user to the rear portion of the collar of the boot.

In the prior art, such lower leg straps include a first strap portion, for example anchored to the lateral side of the collar, a second strap portion then anchored to the medial side of the collar, a mechanism for pairing the two strap portions and mechanism for adjusting the length of one of the two strap portions. The patent documents EP 1 484 992-B1 and US 2005/0102860-A1 describe such a device, in which the pairing mechanism is comprised of a buckle attached to one end of the first strap portion and provided to receive the passage of the second strap portion. The length adjustment mechanism is comprised of two complementary portions of self-gripping bands (that is, bands comprising hook-and-loop fastening portions, such as of the Velcro® type).

In the prior art, it has been proposed to include elastic elements or portions in the lower leg tightening devices. Depending upon the elastic modulus of the elastic elements present in the tightening devices, greater comfort or greater performance will be achieved, but it is not possible to obtain both at the same time. This is particularly the case in the ski boot disclosed in the patent documents EP 1 087 676-B1 and U.S. Pat. No. 6,026,594-A, in which the positioning of a tightening device having an elastic portion is supposed to provide a surplus of energy improving the performance of the skier. However, if the elastic portion is excessively loose, the user will benefit from greater comfort at the expense of performance.

SUMMARY

The present invention provides a lower leg tightening device which will alternatively improve comfort or performance.

The present invention also provides a lower leg tightening device for a sports boot that allows greater modularity of use for the user.

The invention also simplifies the use of the lower leg tightening device for the user.

In view of the foregoing, the invention is directed to a sports boot that includes a shell and a liner, the shell extending upward so as to at least partially surround the lower leg of a user and comprising at least one device for tightening the lower leg of the user, the tightening device including the following:

- a first strap portion attached to the shell using a first anchoring mechanism;
- a second strap portion;
- a mechanism for pairing the first strap portion with the second strap portion;
- a mechanism for adjusting the length of the first strap portion or of the second strap portion; and
- a second anchoring mechanism, provided to optionally connect the second strap portion to the shell.

The user can thus set the sports boot in any of at least two different configurations, each of these configurations being associated with a different state of the second anchoring mechanism, including:

- a connected state in which the second anchoring mechanism connects the second strap portion to the shell; and
- a disconnected state in which the second anchoring mechanism does not connect the second strap portion to the shell.

The first anchoring mechanism can be positioned on one side of the boot, that is, medial or lateral, and the second anchoring mechanism can then be positioned on a second side of the boot, that is, medial or lateral.

A third anchoring mechanism can also be provided to connect the second strap portion to the shell. This third anchoring mechanism may comprise a band and possibly a buckle through which the second strap portion extends.

In one embodiment of the invention, the second anchoring mechanism comprises a hook affixed to the shell, the collar of the shell in particular, and in which the second strap portion extends.

In an alternative embodiment, the second anchoring mechanism comprises a hook affixed to either one of the shell or the second strap portion, the hook cooperating with a ring affixed to the other one of these two elements.

The pairing and length adjustment mechanisms can be in any form known for these types of mechanisms. By way of example and in a non-limiting fashion, either of the following two configurations can be employed:

- a pairing mechanism in the form of a buckle and a length adjustment mechanism in the form of a self-gripping bands of the hook-and-loop fastener type, such as that of the Velcro® type;
- pairing and length adjustment mechanisms combined in the form of a claw buckle.

BRIEF DESCRIPTION OF DRAWINGS

The invention will be better understood upon reading the description which follows, with reference to the annexed drawings, and in which.

DETAILED DESCRIPTION

Figure 1:
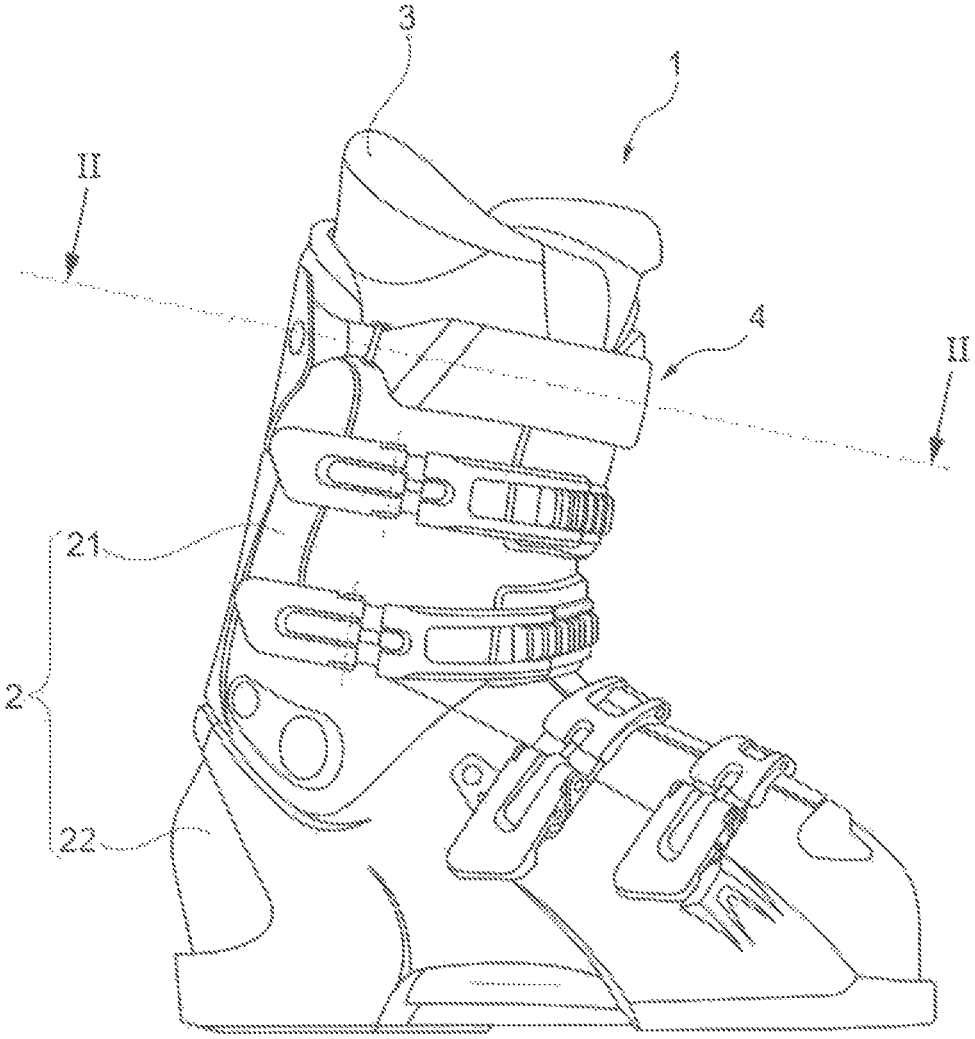
FIG. 1 is a perspective view of a ski boot according to the invention.

FIG. 1 shows a ski boot equipped with a multi-option strap according to a first embodiment of the invention.

The ski boot 1 is comprised of a rigid shell 2, itself comprising a shell base 22 overlaid by a collar 21, the collar extending upwardly from the shell base. The shell base 22 and the collar 21 are obtained, for example, by injection of any of various types of plastic material, such PA (polyamide), PU (polyurethane), PE (polyethylene) or any other injectable material. They can also be made using composite materials, in particular fibers (such as carbon, glass, etc.) embedded in a thermosetting or thermoplastic resin. An inner liner 3 is inserted within the shell 2 to provide comfort for the user. The liner is composed of a glued and/or sewn and/or welded assembly of various elements.

The ski boot 1 includes a plurality of closure devices 5 (such as the upper and lower pairs of devices or buckles), and possibly a multi-option tightening device 4.

Figure 2:
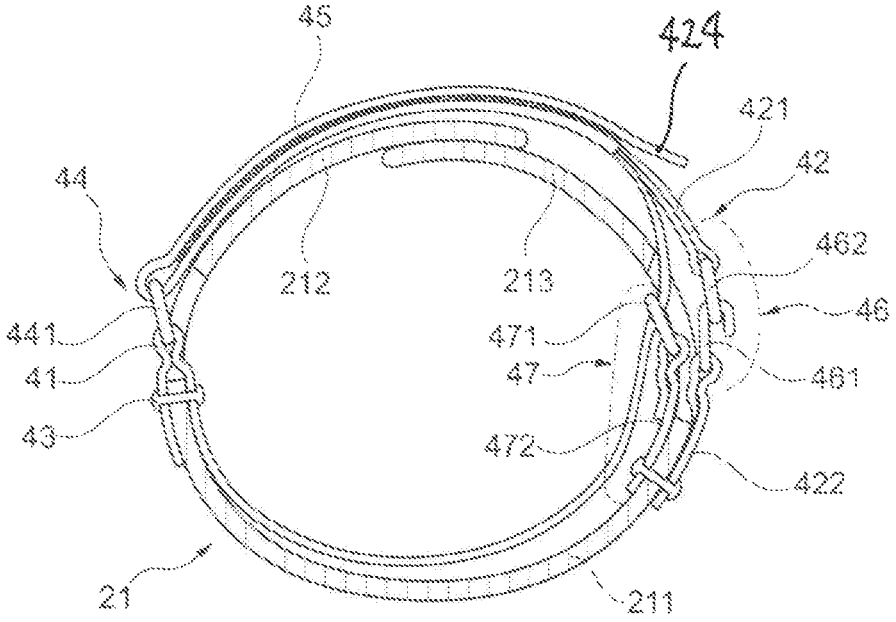
FIGS. 2 and 3 are partial cross-sectional views of the boot of FIG. 1 according to a first embodiment of the invention.
Figure 4:
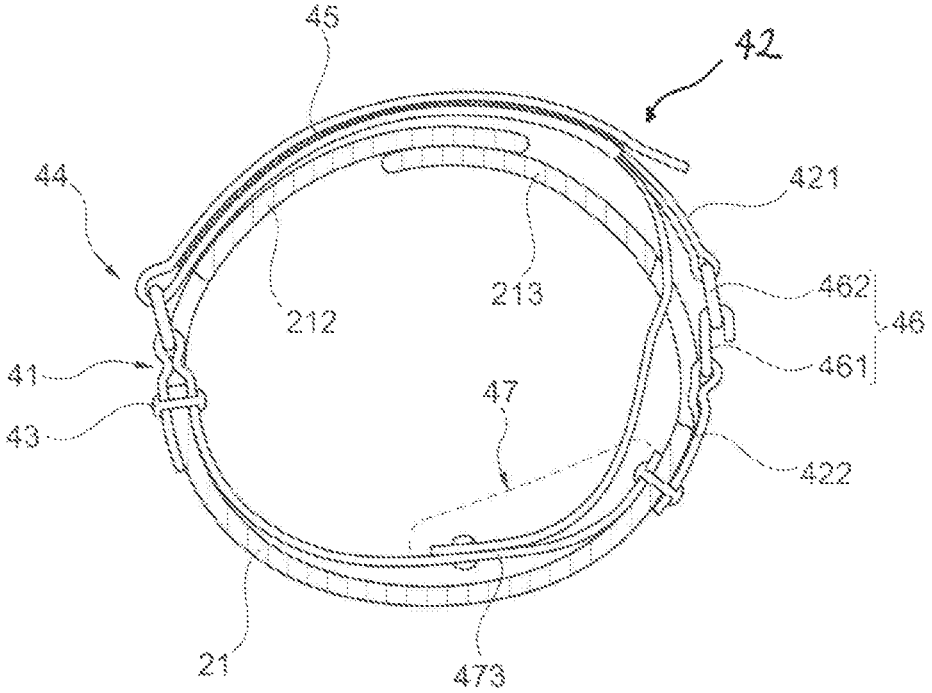
FIGS. 4 and 5 are partial cross-sectional views of the boot of FIG. 1 according to a second embodiment of the invention.

FIGS. 2 and 4 illustrate a partial cross section of the boot along a substantially horizontal plane. The collar 21 comprises a rear portion 211 configured to be opposite the rear portion of the lower leg of the user. The rear portion 211 is extended on the medial side and lateral side by medial and radial overlaps 212, 213, respectively. The sliding of the medial overlap 212 on the radial overlap 213 makes it possible to adapt the circumference of the collar 21 to the user.

The multi-option device 4 for tightening the lower leg of the user, according to the first embodiment, comprises a first strap portion 41 attached to the collar 21 using a first anchoring mechanism 43. In this case, the first anchoring mechanism (or "first anchor") 43 is permanently affixed or essentially permanently affixed to the medial side of the collar. The first anchoring mechanism 43 may include a rivet or a screw-nut assembly, for example. In an alternative embodiment, mechanisms can be provided to change the precise position of the first anchoring mechanism 43. For example, an upper position and a lower position may be provided for better adaptation to the morphology of the user. Although a modification of the position of the first anchoring mechanism 43 may be provided, it is nevertheless considered that the attachment of the first anchoring mechanism is permanent or essentially permanent insofar as the first strap portion 41 will always be anchored to the collar, irrespective of the precise position thereof.

The multi-option tightening device 4 according to the invention comprises a second strap portion 42 which, together with the first strap portion 41, ensures surrounding of the lower leg of the user. A pairing mechanism 44 (or "pairer") and a mechanism 45 for adjusting the length of one of the two strap portions (or "length adjuster") are provided to ensure adaptation to the circumference desired by the user. In the specific case of the first embodiment of the invention, the pairing mechanism 44 is comprised of a buckle 441 attached to the end of the first strap portion 41 and through which the second strap portion 42 extends. The length adjustment mechanism 45 comprises two bands made of self-gripping material, such as hook-and-loop fasteners, such as of the of the Velcro® type, which are attached to the second strap portion 42.

According to the invention, a second, non-permanent anchoring mechanism 46 is provided to connect the second strap portion 42 to the collar 21 of the shell 2 on the side opposite the side on which the first anchoring mechanism 43 is attached. In this case, the second anchoring mechanistic 46 comprises a hook 461 and a ring 462, the hook being configured to cooperate with the ring. The ring 462 is attached to the second strap portion 42 via a first band 421 and through which the second strap portion 42 extends. The hook 461 is attached to the collar 21 via a second band 422.

Figure 3:
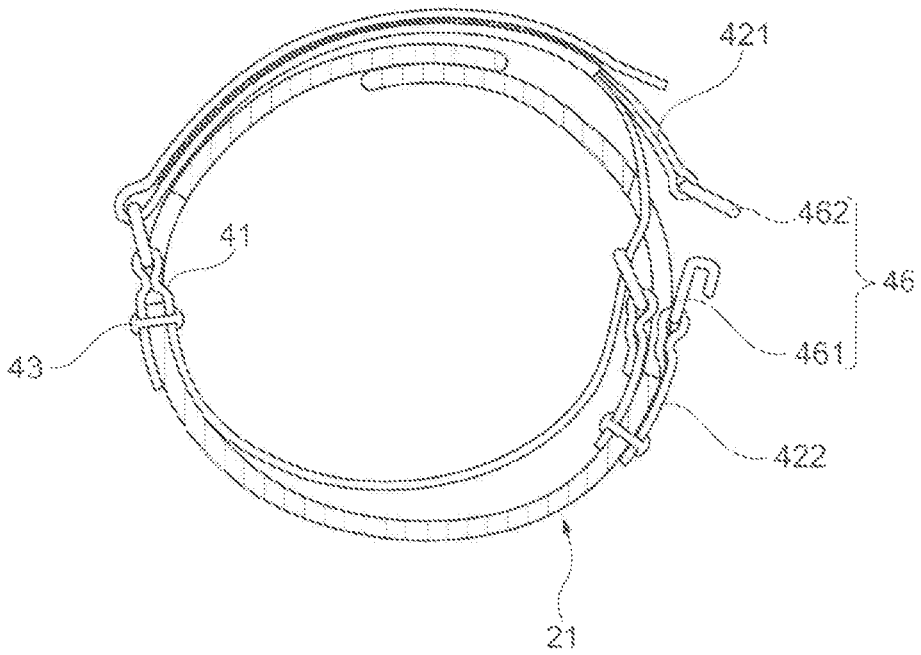

Optionally, a third anchoring mechanism 47 is provided between the second strap portion 42 and the collar 21. This third anchoring mechanism 47 is permanent or essentially permanent, meaning that the user will not have to undo it during daily use of the ski boot. In the first embodiment shown in FIGS. 2 and 3, the third anchoring mechanism 47 is comprised of a buckle 471 attached to one end of a band 472. The other end of the band 472 is attached to the collar 21. As shown in FIGS. 2 and 3, the first strap portion 41 extends through the buckle 471.

Figure 5:
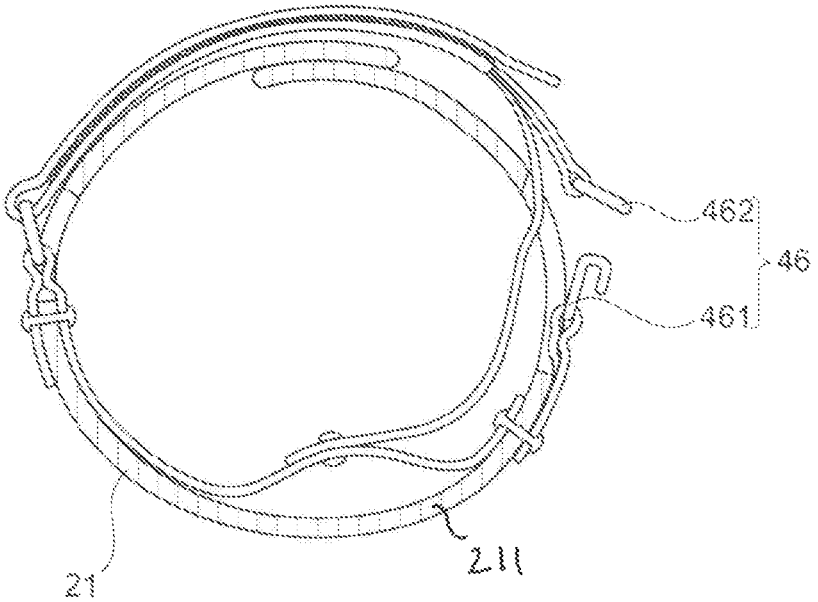

In the second embodiment shown in FIGS. 4 and 5, the third anchoring mechanism 47 is comprised of a band 473, one end of which is attached to the second strap portion 42 and the other end of which is attached to the collar 21.

The third anchoring mechanism 47 guarantees, among other things, a better positioning of the second strap portion 42, in particular in the configuration of the multi-option strap 4 (see FIG. 1) which is described hereinafter with reference to FIGS. 3 and 5.

In the configuration of the multi-option strap shown in FIGS. 2 and 4, the second anchoring mechanism 46 (or "second anchor") is in a connected state, and the band 472 behaves like a lower leg strap of the prior art. The user exerts traction on the free end 424 of the second strap portion 42. This traction is transmitted to the medial portion of the collar 21 via the pairing mechanism 44 and the first strap portion 41, on the one hand, and to the lateral portion of the collar via the second anchoring mechanism 46, on the other hand. When the desired circumference is reached, the user folds the free end 424 so that the two Velcro® bands of the length adjustment mechanism 45 interconnect with each one another and the tightening is maintained.

The user can select this first configuration when performance is desired, that is to say, in order to ski faster and in a more engaged manner. In this configuration, the liner, and therefore the lower leg of the user, is firmly held in the rigid shell. In terms of proprioception, the skier is aware of the forward and backward support offered simultaneously by the shell 2.

FIGS. 3 and 5 show the ski boot in a second configuration. The second anchoring mechanism 46 is in a disconnected state. Indeed, the hook 461 is no longer retained by the ring 462. As a result, the collar 21 and the second strap portion 42 are no longer connected on the lateral side of the boot. Therefore, even when the lower leg tightening device is tightened, the lower leg has a certain laxity as the boot is no longer pressed against the rear portion 211 of the collar.

The user can select this second configuration when greater comfort is desired. In this configuration, the liner, and therefore the leg of the user, retains the support of the front portion of the base.

Figure 6:
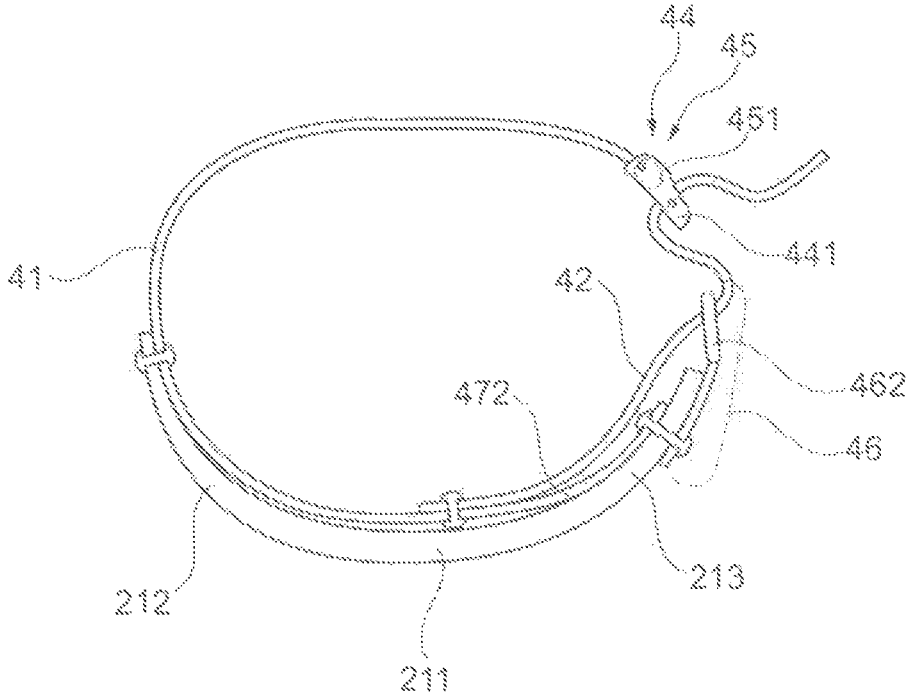
FIGS. 6 and 7 are partial cross-sectional views according to a third embodiment of the invention.
Figure 7:
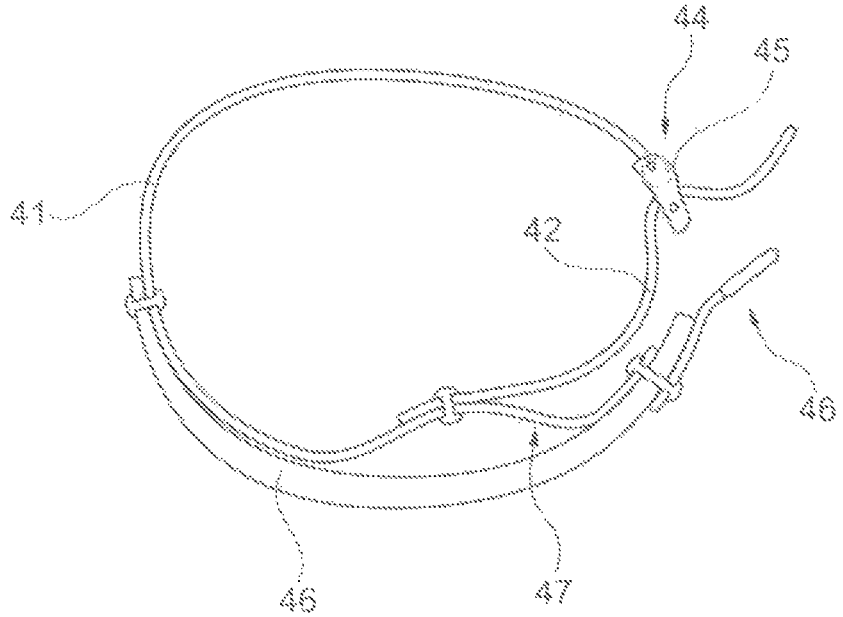

FIGS. 6 and 7 partially illustrate a third embodiment of the invention. The third embodiment differs from the second embodiment, firstly by mechanism 44 for pairing the first loop portion 41 with the second loop portion 42, as well as adjustment mechanism 45 which are different from those present in the second embodiment.

Indeed, in the third embodiment of the invention, the pairing mechanism 44 and the length adjustment mechanism 45 are combined on the same element referred to as the claw buckle.

The claw buckle includes a buckle 441 attached to the free end of the second strap portion 42, and a claw 451 pivotally mounted in the buckle, such that when the first strap portion 41 is pulled in the direction of tightening, the claw 451 pivots to allow the strap to slide, whereas when the strap attempts to slide in the direction of loosening, the claw is positioned so as to block the passage and prevent sliding.

Secondly, the third embodiment also differs from the second embodiment by the second anchoring mechanism. Indeed, the latter is now only comprised of a simple ring 462 through which the first strap portion 41 extends (FIG. 6) or does not extend (FIG. 7).

A third anchoring mechanism is provided between the second strap portion 42 and the collar 21. This third anchoring mechanism is permanent. In this case, the third anchoring mechanism 47 is comprised of a band 472 attached to the second strap portion 42, on the one hand, and to the collar 21, on the other hand.

The invention is not limited to the three embodiments that are illustrated in FIGS. 1 to 7. Any equivalent construction is also within the scope of the invention.

Further, at least because the invention is disclosed herein in a manner that enables one to make and use it by virtue of the disclosure of particular exemplary embodiments, such as for simplicity or efficiency, for example, the invention can be practiced in the absence of any additional element or additional structure that is not specifically disclosed herein.

The invention claimed is:

1. A sports boot comprising:

a shell comprising a collar; and a liner;

the shell extending upward so as to at least partially surround a lower leg of a user, and comprising at least one tightener of the lower leg of the user;

the at least one tightener comprising:

a first strap portion attached to the shell by means of a first anchor, the first anchor being positioned on one of a medial side of the boot or a lateral side of the boot;

a second strap portion;

a pairer configured to pair the first strap portion with the second strap portion;

a length adjuster configured to adjust a length of the first strap portion or a length of the second strap portion, wherein the length adjuster is hook-and-loop fastening bands;

the at least one tightener further comprising:

a second anchor configured to connect the second strap portion to the shell; and the second anchor configured to be alternately positioned in two different states, including:

a connected state in which the second anchor connects the second strap portion to the shell, the second anchor being positioned on a second of the medial side of the boot or the lateral side of the boot, and the second anchor comprising a hook affixed to either one of the shell or the second strap portion, said hook cooperating with a ring affixed to the other one of the shell or the second strap portion; and a disconnected state in which the second anchor does not connect the second strap portion to the shell.

2. The sports boot according to claim 1, further comprising:

a third anchor configured to connect the second strap portion to the shell.

3. The sports boot according to claim 2, wherein:

the third anchor comprises a band.

4. The sports boot according to claim 1, further comprising:

a third anchor comprising a buckle through which the first strap portion extends.

5. The sports boot according to claim 1, wherein:

the second anchor comprises the ring attached to the shell and through which the second strap portion extends.

6. The sports boot according to claim 5, wherein:

the shell comprises a shell base wherein the collar is overlying and extending upwardly from the shell base.

* * * * *